US009359120B2

(12) United States Patent
Kovell

(10) Patent No.: US 9,359,120 B2
(45) Date of Patent: Jun. 7, 2016

(54) BLISTER PACKAGING INCLUDING A BLISTER WITH SYMMETRY

(71) Applicant: L'ORÉAL, Paris (FR)

(72) Inventor: Maxim Kovell, East Brunswick, NJ (US)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 14/514,157

(22) Filed: Oct. 14, 2014

(65) Prior Publication Data

US 2016/0101920 A1 Apr. 14, 2016

(51) Int. Cl.
*B65D 75/36* (2006.01)

(52) U.S. Cl.
CPC ..... *B65D 75/366* (2013.01)

(58) Field of Classification Search
CPC ..... B65D 75/36; B65D 75/366
USPC ..... 206/214, 224, 371, 461, 471, 775, 806; D9/415, 418
See application file for complete search history.

(56) References Cited

U.S. PATENT DOCUMENTS

| | | | | | |
|---|---|---|---|---|---|
| 3,367,491 | A | | 2/1968 | Dunham et al. | |
| D213,309 | S | * | 2/1969 | Appeal et al. | D9/415 |
| D269,159 | S | * | 5/1983 | Honig | D9/415 |
| 4,905,832 | A | * | 3/1990 | Boll | B65D 75/366 206/471 |
| D313,182 | S | * | 12/1990 | Diepois | D9/415 |
| 5,186,499 | A | * | 2/1993 | Mason | G09F 3/10 206/461 |
| D354,911 | S | * | 1/1995 | Weatherford | D9/415 |
| D359,678 | S | * | 6/1995 | Weatherford | D9/415 |
| D359,679 | S | * | 6/1995 | Weatherford | D9/415 |
| D378,272 | S | * | 3/1997 | Weatherford | D9/415 |
| 6,311,839 | B1 | * | 11/2001 | Lo | B65D 75/366 206/371 |
| 7,866,481 | B2 | * | 1/2011 | Perkins-Stanaford | B65D 77/0406 206/775 |
| 2005/0218027 | A1 | * | 10/2005 | Lammers | B65D 75/366 206/461 |
| 2013/0341230 | A1 | | 12/2013 | Brandel et al. | |

FOREIGN PATENT DOCUMENTS

| | | |
|---|---|---|
| WO | WO 2005/066036 | 7/2005 |

* cited by examiner

*Primary Examiner* — Bryon Gehman
(74) *Attorney, Agent, or Firm* — Oblon, McClelland, Maier & Neustadt, L.L.P.

(57) ABSTRACT

In selected embodiments, a product packaging container includes a rectangular blister card including an aperture that is positioned in a widthwise direction and near an end in the lengthwise direction. A blister can be arranged in a diagonal lengthwise direction of the blister card and is sealed to the blister card. The blister further includes a blister shell that secures a product therein and a flange that extends from the perimeter of the blister shell out. An edge of the flange on a first end of the blister can include an indentation to avoid a hang hole on the blister card. A second end of the blister is shaped the same as the first end whereby the blister has point symmetry about a center point of the blister.

10 Claims, 6 Drawing Sheets

BLISTER PACKAGING INCLUDING A BLISTER WITH SYMMETRY

BACKGROUND

1. Field of the Invention

The disclosure relates to packing of consumer products. Specifically, the use of a blister pack.

2. Description of the Related Art

Consumer products are sold in various retail locations. Conventional packaging for the retail sale of consumer products includes display packs that not only allow unobstructed viewing of a product without opening the packaging, but also prevents tampering with the product, deter theft of the product, and limit retailer costs of an unsaleable product due to damage to the packaging.

One example of such packaging is a blister pack. A clear plastic blister in combination with a cardboard, corrugated fiberboard, or paperboard frame that encloses the outer edges of the blister. The consumer product is enclosed within the blister, and the combination of the blister and the corrugated frame prevents easy access to the product while also providing a protective shield to the enclosed product and still allowing a consumer to view the product. Blister packs are also useful for protecting products against external factors such as humidity and contamination.

The blister pack may include a hang hole which allows the blister pack to be hung on a peg in a retail store, so that the product can be easily viewed by a consumer. However, retail stores are limited in how much space they can display products, so the larger packages are more difficult to display and also limit the number of products to be displayed.

SUMMARY

In selected embodiments, a product packaging container includes a rectangular blister card including an aperture that is positioned in a widthwise direction and near an end in the lengthwise direction. A blister can be arranged in a diagonal lengthwise direction of the blister card and is sealed to the blister card. The blister further includes a blister shell that secures a product therein and a flange that extends from the perimeter of the blister shell out. An edge of the flange on a first end of the blister can include an indentation to avoid a hang hole on the blister card. A second end of the blister is shaped the same as the first end whereby the blister has point symmetry about a center point of the blister.

The symmetry of the blister enables a more efficient sealing process between the blister and the blister card.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1A:
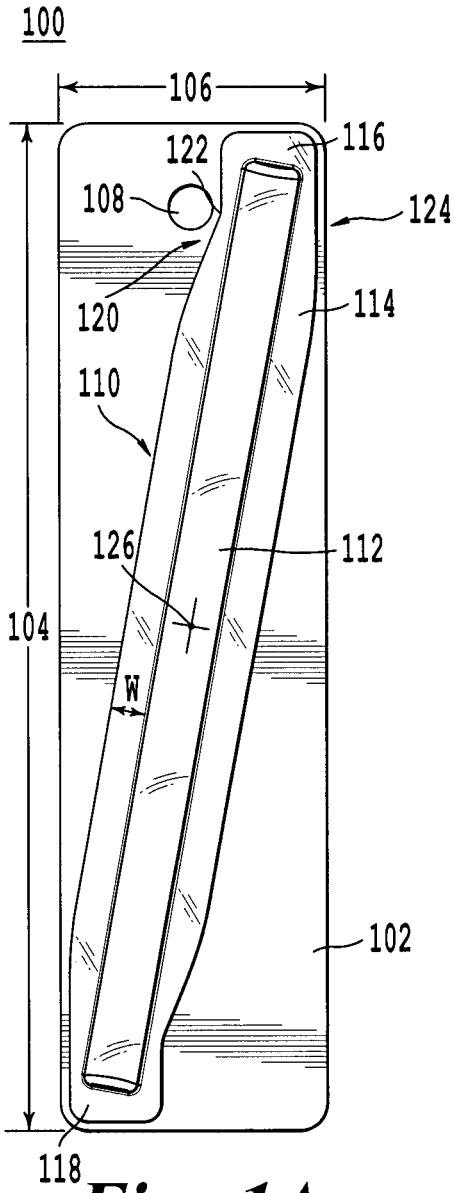
FIG. 1A-F illustrates an isometric, front, side and back view of an exemplary embodiment of a blister pack for a consumer product according to one example.

A more complete appreciation of the present advancements and many of the attendant advantages thereof will be readily obtained as the same becomes better understood by reference to the following detailed description when considered in connection with the accompanying drawings. However, the accompanying drawings and their exemplary depictions do not in any way limit the scope of the advancements embraced by the specification. The scope of the advancements embraced by the specification and drawings are defined by the words of the accompanying claims.

Selected embodiments are now described by referring to the drawings, wherein like reference numerals designate identical or corresponding parts throughout the several views. It is noted that, as used in the specification and the appending claims, the singular forms "a," "an," and "the" can include plural references unless the context clearly dictates otherwise.

A blister pack is a type of packaging for displaying consumer products in a retail location. The consumer product is placed between a paperboard blister card and a clear preformed plastic such as polyvinyl chloride (PVC) or polyethylene terephthalate (PET). Various types of consumer products, such as toys, cosmetics, hardware, or electrical items can be placed in a blister pack. However, the present disclosure is not so limited, as a number of different products can be placed within a blister pack.

Consumer products such as cosmetic pencils come in various sizes, long, short, thin, thick, etc. Cosmetic pencils that are long and thin provide a unique challenge when the size of the blister card is a limiting factor. If the cosmetic pencil is larger than a length of the blister card, the cosmetic pencil can be positioned at an angle off center, and be positioned diagonally from one corner to a diagonally opposite corner of the blister card. If a cosmetic pencil is positioned from one corner to the diagonally opposite corner, a space can be created near the top of the blister card and to the side of the cosmetic pencil to provide an aperture or hole. The hole enables the retailer to hang the product from a peg in the store. The hole can be centered in a lengthwise direction near the top of the card, so that the product can balance as it hangs.

Referring to FIG. 1A, a front view of an embodiment of the present disclosure is illustrated according to one example. The blister pack 100 includes a blister card 102. The blister card 102 can be fabricated of cardboard, corrugated fiberboard, paperboard frame, laminated materials, printed card, foil, plastic or the like. The blister card can have any geometric shape including regular and irregular shapes. In a non-limiting embodiment, the blister card 102 includes a geometric shape having a major axis along a major dimension, and at least one minor dimension along a minor axis. For example, the blister card 102 can have a substantially rectangular shape, for example, with a length 104 and a width 106. A major axis of the blister card 102 is parallel to the length 104 of the blister card 102, and perpendicular to the width 106. A minor axis of the blister card 102 is parallel to the width 106 and perpendicular to the length 104.

The length 104 and the width 106 of the blister card 102 are normally pre-set, and the consumer product needs to fit within the constraints of the blister card 102. For example, in a non-limiting embodiment, the length 104 of the blister card can be 7.063 inches, and the width 106 can be 1.875 inches. In an exemplary embodiment, a ratio between the length 104 and the width 106 of the blister card 102 can be between 0.25 and 0.28, but preferably between 0.26 and 0.27. The length and width of the blister is dependent on the consumer product. In the present embodiment, the length of the blister to hold the comestic pencil can be 7 inches, whereas the length of the blister card can be 7.063 inches.

The blister card 102 can have a hang hole 108. The hang hole 108 can be positioned in the center of the minor axis, near one end of the major axis. By placing the hang hole 108 substantially centered, the blister pack 100 can balance as it hangs in the retail store.

The blister card 102 further includes a blister 110. The blister can be made of a clear, transparent plastic. For example, PVC, PET, polyethylene, or the like. The blister 110 includes a blister shell 112 and a face seal flange 114.

The blister shell 112 can be vacuum-formed around a mold (not shown), so that the blister shell 112 is hollow and allows the consumer product to be contained within in the blister shell 112. For example, the blister 110 can contain the consumer product snugly around the entire product, or alternatively, secure only a portion of the product. The mold used to create the blister 110 can be shaped substantially similar to the consumer product. For example, the mold can be same shape and size as the consumer product that will be placed in the blister shell 112, or the mold can only be at least substantially the same shape. The consumer product in one or more present embodiments is a cosmetic pencil that can be long and thin. However, the present disclosure is not so limited and other consumer products such as toys, cosmetics, hardware, or electrical items could be placed in the blister pack. The shape, size, volume, etc. of the blister shell 112 is dependent on the consumer product being packaged.

The face seal flange 114 of the blister 110 enables the face of the face seal flange 114 to be sealed to the face of the blister card 102. The face seal flange 114 needs a predetermined minimum width to ensure a proper sealing of the face seal flange 114 to the blister card 102. The face seal flange 114 needs to avoid the hang hole 108, because if the sealing flange overlaps the hole or the hole punctures the face seal flange after sealing, the sealing of the blister 110 to the blister card 102 can be affected. For example if the hang hole 108 is punctured after the sealing process and the hang hole 108 punctures a portion of a face seal flange 114 of the blister 110, the hang hole 108 can weaken the seal and potentially prevent a sufficient seal. Alternatively, if the hole is punched before the sealing, and the face seal flange 114 partially overlaps the hang hole 108, the blister 110 might not provide an adequate seal. This can also affect to ability of being able to hang the product at retail store. Therefore, the face seal flange 114 of the blister 110 can be shaped so that the face seal flange 114 avoids the location of the hang hole 108.

The blister 110 can be secured to the blister card 102 at an angle off the major axis, so that the blister is in between the hang hole 108 and an edge of the blister card 102. For example, the blister 110 can be angled at an angle between 8° and 15° off the major axis, with each end of the blister 110 in diagonally opposite corners of the blister card 102. In this manner, the blister 110 can be oriented in two possible directions, 8° and 15° in one direction off the major axis, or 8° and 15° in the opposite direction off the major axis.

The face seal flange 114 surrounds the perimeter of the blister shell 112. The face seal flange 114 is secured and/or sealed to the blister card 102. For example, the blister 110 material can be sealed to a coating on the blister card 102 to secure the face seal flange 114 to the blister card by way of heat and pressure. Various other methods known to one skilled in the art could be used to seal the face seal flange 114 to the blister card 102.

Figure 1B:
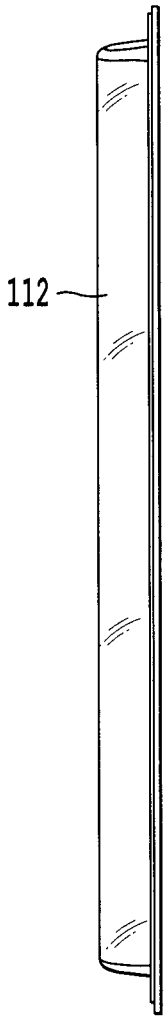

After the face seal flange 114 is sealed to the blister card 102, the face seal flange 114 can be on top of the blister card 102, as illustrated in the side view FIG. 1B. In other words, the plane of the face seal flange 114 and the plane of the blister card 102 are substantially parallel. Alternatively, the face seal flange 114 can be compressed into the blister card 102 and become coplanar with the blister card 102.

The hang hole 108 can be punched in the blister card 102 before or after the sealing process. The hang hole 108 can be punched on only one end of the blister card. If the hang hole 108 is punched through the face seal flange 114, the hole can weaken the seal between the face seal flange 114 and the blister card 114. Alternatively, if the face seal flange 114 covers the hole during the sealing process, the resultant seal may be insufficient and the product may not be able to be displayed in the retail store by hanging the product from the peg. In order to avoid these problems, the face seal flange 114 can be shaped in a way as to avoid the location of the hang hole 108.

Since the hang hole 108 is punched on only one end of the blister card, only the portion of the face seal flange 114 relatively close to the hang hole 108 needs to be shaped to avoid the hole. However, during the sealing process, the orientation of blister 110 is taken into consideration.

For example, during the packaging process of the consumer product, the blister card 102 is printed and oriented in a specific direction. The blister 110 is also oriented in a specific direction. The manufacturing process can be improved if the orientation process for any of these steps could be reduced or eliminated. Therefore, since the blister 110 is designed on one end to avoid the hang hole 108, if the other end of the blister 110 is designed the same way, then the orientation of the blister 110 does not play a factor in the sealing process. In other words, if blister 110 is designed to have point symmetry, or 180° rotational symmetry about the center 126 of the blister 110, then blister does not need to be oriented during the sealing process. Thus, either end of the blister 110 that is feed into the machinery will avoid the hang hole 108 during the sealing process. The loading of the blister 110 is automated, and since the machine does not need to orient the blister 110, considerable time and expense are saved.

A non-limiting embodiment of a point symmetric or 180° rotationally symmetric blister 110 is illustrated in FIG. 1A. The face seal flange 114 can have a width w around the perimeter of the blister shell 112. The perimeter of the face seal flange 114 on each side of the blister 110 is substantially parallel. However, the width of the flange 114 varies as the face seal flange 114 near a first end 116 and near a second end 118 of the blister 110. A side surface on a hole side 120 of the face seal flange 114 near the first end 116 of the blister 110 is shaped to avoid the hang hole 108. For example, on a hole side 120 of the first end 116 of the face seal flange 114, there is an indentation 122. The indentation 122 angles in toward the perimeter of the blister shell 112 for a predetermine distance, and angles out for a predetermined distance. An apex of the indentation 122 can be on the same plane as the center of the hang hole 108. The indentation 122 can also be a notch, cut, recess or the like that avoid the location of the hang hole 108.

A side surface on an edge side 124 of the face seal flange 114, which is opposite of the hole side 120, is shaped differently. For example, as the face seal flange 114 approaches the first end 116 of the blister 110 on the edge side 124 of the face seal flange 114, the face seal flange 114 angles in toward the perimeter of the blister shell 112, but parallel to the edge of the blister card 102. The angle of the seal face flange 114 causes it to avoid an edge of the blister card 102. In order to maintain a sufficient seal, the face seal flange 114 needs a predetermined minimum width between the perimeter of the blister shell 112 and the perimeter of the face seal flange 114.

The face seal flange 114 near the second end 118 can be formed substantially similar to the face seal flange 114 near first end 116 of the blister 110. The blister 110 can have point symmetry about a symmetry point 126, or 180° rotation symmetry with an order of 2. However, the hang hole 108 is only on one end of the major axis, which according to this embodiment would be near the first end 116 of the blister 110.

Figure 1C:
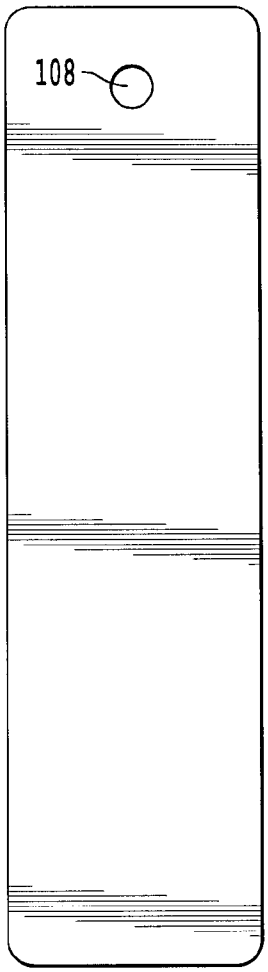

FIGS. 1B and 1C illustrate a side view and a back view of the blister pack 100 respectfully. The blister shell 112 can have a height that extends a predetermined distance. The height of the shell 112 is dependent upon the consumer product that is being packaged in the blister pack 100. The back view of the blister pack 100 only illustrates the hang hole 108 that is located near one end of the major axis.

Figure 1D:
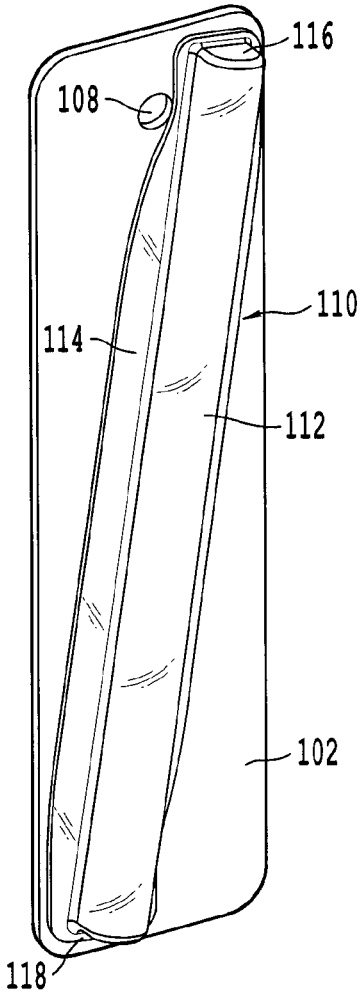
Figure 1E:
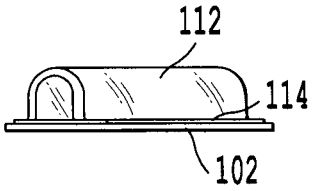
Figure 1F:
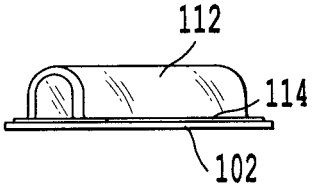

FIG. 1D illustrates an isometric view of the present embodiment. FIGS. 1E and 1F illustrate a top view and a bottom view, respectively, of the present embodiment.

Figures 2A, 2B, 2C:
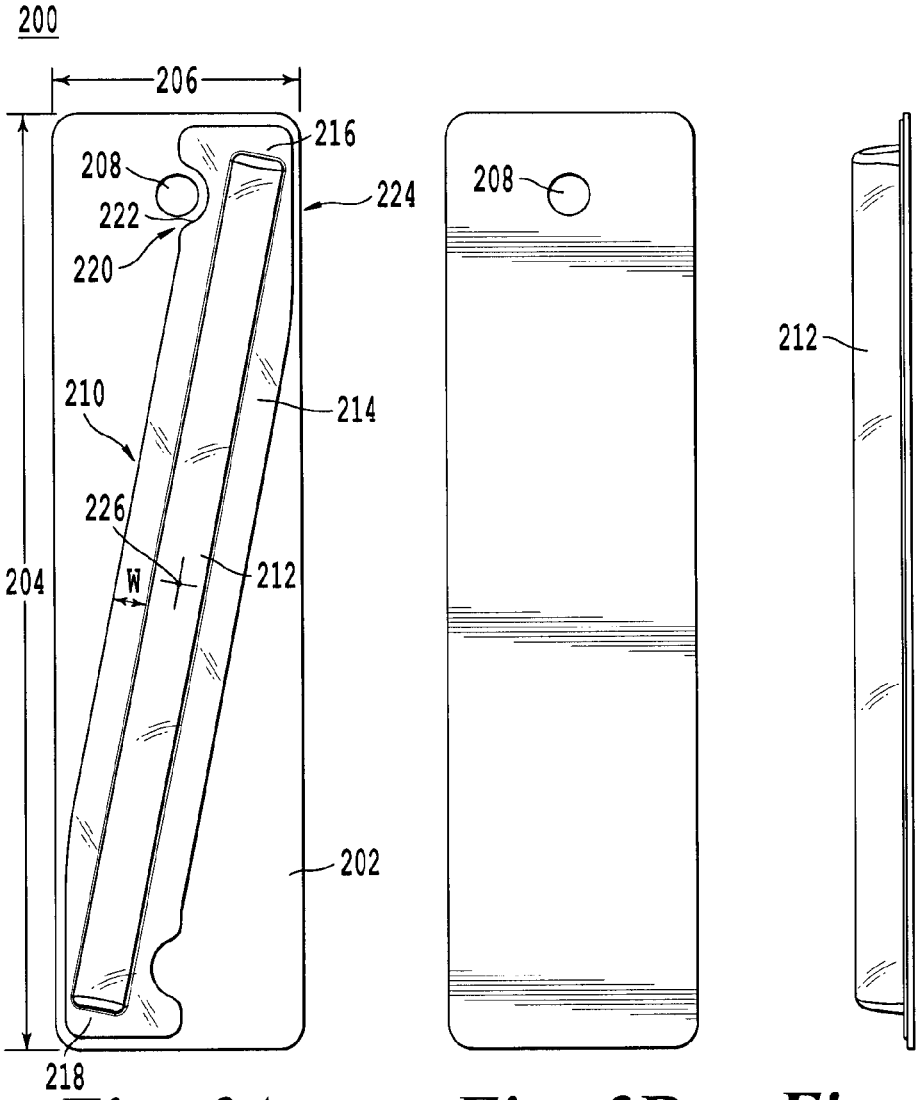
FIGS. 2A-2C illustrates a front, side and back view of an exemplary embodiment of a blister pack for a consumer product according to one example.

There are several different embodiments in regards to the shape of the face seal flange. FIG. 2A illustrates a blister pack 200 that includes a blister 210 in accordance to another embodiment. The blister 210 can have a blister shell 212 and a face seal flange 214. The blister shell 212 is similar to the embodiment illustrated in FIG. 1A; however the face seal flange 214 is shaped differently. The face seal flange 214 has an indentation 222 on a hole side 220 near a first end 216. The indentation 222 can have an arc shape that at least partially surround the hang hole 208 but also avoids the hang hole 208. In other words, the face seal flange 114 does not overlap the hang hole 208. The radius of the arc shaped indentation 222 is greater than the radius of the hang hole 208.

A side surface on an edge side 224 of the face seal flange 214, which is opposite of the hole side 220, is shaped differently. For example, as the face seal flange 214 approaches the first end 216 of the blister 210 on the edge side 224 of the face seal flange 214, the face seal flange 214 angles in toward the perimeter of the blister shell 212, but parallel to the edge of the blister card 202. The angle of the seal face flange 214 causes it to avoid an edge of the blister card 202. In order to maintain a sufficient seal, the face seal flange 214 needs a predetermined minimum width between the perimeter of the blister shell 212 and the perimeter of the face seal flange 214.

The face seal flange 214 near the second end 218 can be formed substantially similar to the face seal flange 214 near first end 216 of the blister 210. The blister 210 can have point symmetry about a symmetry point 226, or 180° rotation symmetry with an order of 2. However, the hang hole 208 is only on one end of the major axis, which according to this embodiment would be near the first end 216 of the blister 210.

FIGS. 2B and 2C illustrate a side view and a back view, respectively, of the embodiment of the blister pack 200 shown in FIG. 2A.

Figure 3A:
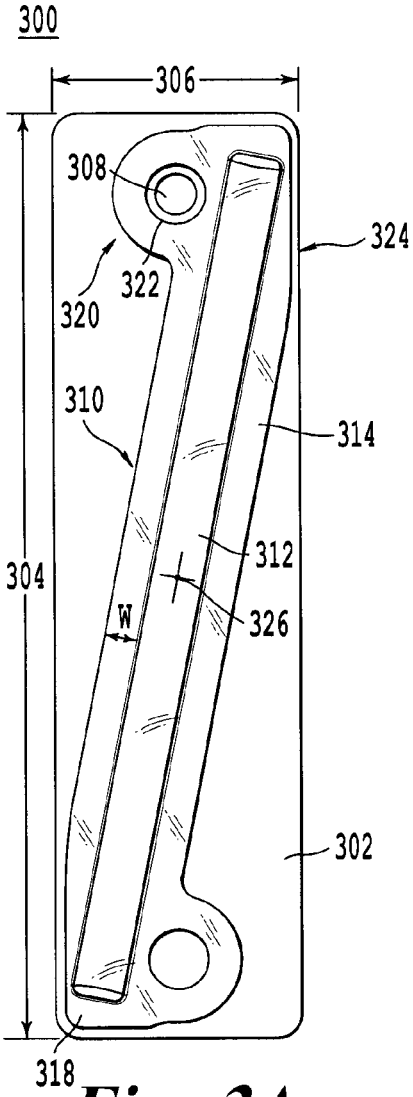
FIGS. 3A-3C a front, side and back view of an exemplary embodiment of a blister pack for a consumer product according to one example.

FIG. 3A illustrates a blister pack 300 includes a blister 310 in accordance to another embodiment. The blister 310 can have a shell 312 and a face seal flange 314. The shell 312 is similar to the embodiment illustrated in FIG. 1A; however the face seal flange 314 is shaped differently. The face seal flange 314 does not have indentation on a hole side 320 of a first end 316. In contrast, the face seal flange 314 can have an arc or loop shape that extends around the location of a hang hole 308. The face seal flange 314 can have a hole 322 that encircles the hang hole 308, so that the face seal flange 314 does not cover the hang hole 308. The diameter of the hole 322 is greater than the diameter the hang hole 308. The hole 322 allows the hang hole 308 to be punched in the blister card 302 without puncturing the face seal flange 314 or having the face seal flange 314 overlap the hang hole 308 to prevent an adequate seal. The face seal flange 314 according to this embodiment has the added benefit of reinforcing the hang hole 308.

A side surface on an edge side 324 of the face seal flange 314, which is opposite of the hole side 320, is shaped differently. For example, as the face seal flange 314 approaches the first end 316 of the blister 310 on the edge side 324 of the face seal flange 314, the face seal flange 314 angles in toward the perimeter of the blister shell 312, but parallel to the edge of the blister card 302. The angle of the seal face flange 314 causes it to avoid an edge of the blister card 302. In order to maintain a sufficient seal, the face seal flange 314 needs a predetermined minimum width between the perimeter of the blister shell 312 and the perimeter of the face seal flange 314.

The face seal flange 314 near the second end 318 can be formed substantially similar to the face seal flange 314 near first end 316 of the blister 310. The blister 310 can have point symmetry about a symmetry point 326, or 180° rotation symmetry with an order of 2. However, the hang hole 308 is only on one end of the major axis, which according to this embodiment would be near the first end 316 of the blister 310.

Figure 3B:
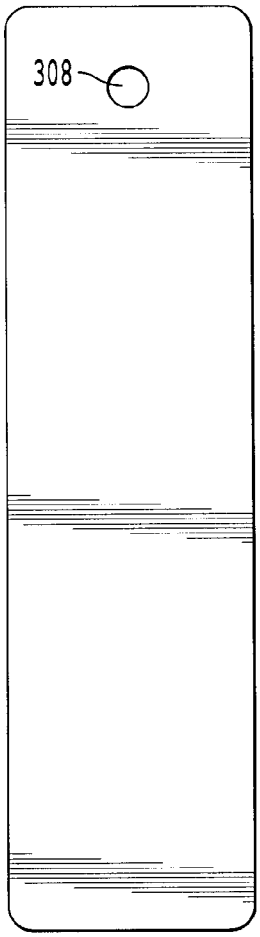
Figure 3C:
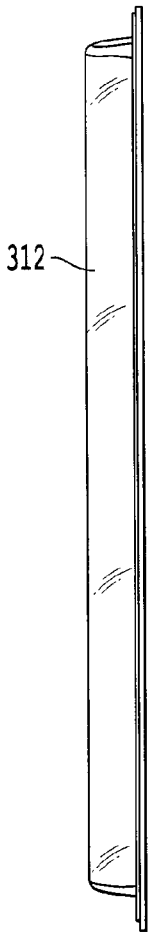

FIGS. 3B and 3C illustrate a side view and a back view, respectively, of the embodiment of the blister pack 300 shown in FIG. 3A.

In the previous embodiments illustrated, the hole side of the face seal flange and the edge side of the face seal flange are shaped differently near the first end, and are mirrored on the face seal flange near second end of the blister. In another embodiment, the shape of the face seal flange is the same on the hole side and the edge side. An example is illustrated in another embodiment FIG. 4A.

Figure 4A:
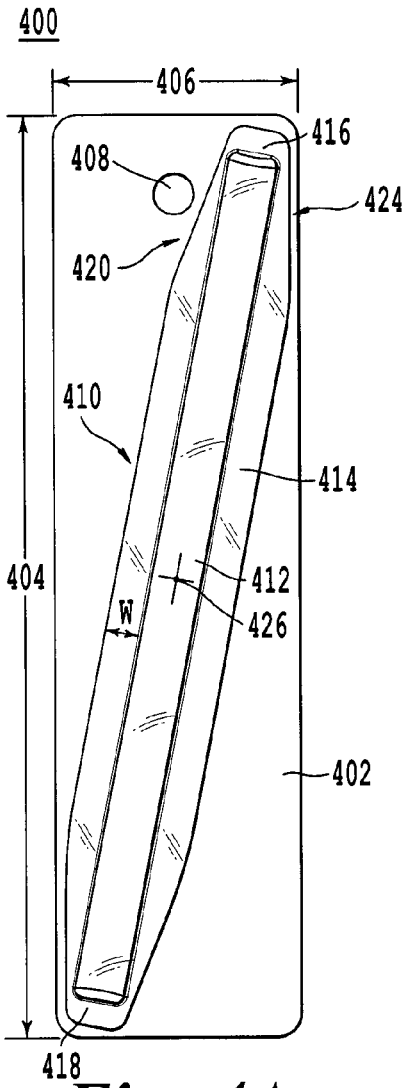
FIGS. 4A-4C a front, side and back view of an exemplary embodiment of a blister pack for a consumer product according to one example.

FIG. 4A illustrates a blister pack 400 with a blister 410 in accordance to another embodiment. The blister 410 can have a blister shell 412 and a face seal flange 414. The blister shell 412 is similar to the embodiment illustrated in FIG. 1A; however the face seal flange 414 is shaped differently.

The face seal flange 414 on a hole side 420 near a first end 416 and the face seal flange 414 on an edge side 424 converge to the perimeter of the blister 410 at substantially the same angle. The face seal flange 414 is substantially linear on both the hole side 420 and the edge side 424 as it converges toward the perimeter of the blister 410. However, the face seal flange maintains a minimum predetermined width between the blister shell 412 and the perimeter of the face seal flange 414 to ensure an adequate seal between the face seal flange 414 and the blister card 402. The face seal flange 414 on the edge side 424 is substantially parallel to the edge of a blister card 402. The angle of the seal face flange 414 causes it to avoid the edge of the blister card 402. The angle of face seal flange 414 on the hole side 420 causes the face seal flange 414 to avoid a hang hole 408. Therefore, the face seal flange 414 on the hole side 420 near the first end 416 is substantially similar to the face seal flange 414 on the edge side 424 near the first end 416.

The face seal flange 414 near the second end 418 is a mirror image of the face seal flange 414 near first end 416 of the blister 410. The blister 410 has point symmetry about a symmetry point 426, or 180° rotation symmetry with an order of 2. However, the hang hole 408 is only on one end of the major axis, which according to this embodiment would be near the first end 416 of the blister 410.

Figure 4B:
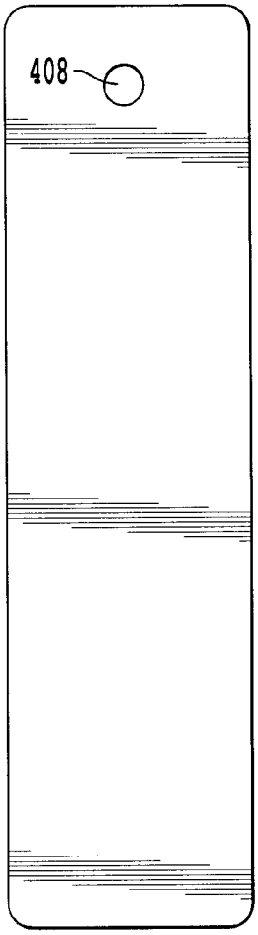
Figure 4C:
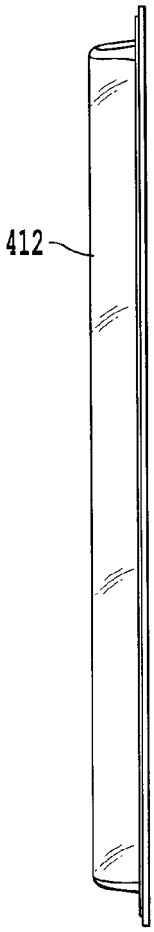

FIGS. 4B and 4C illustrate a side view and a back view, respectively, of the embodiment of the blister pack 400 shown in FIG. 4A.

Obviously, numerous modifications and variations of the present invention are possible in light of the above teachings. It is therefore to be understood that within the scope of the appended claims, the invention may be practiced otherwise than as specifically described herein.

What is claimed is:

1. A product packaging container comprising:

a rectangular blister card having a width and length, the blister card including an aperture that is positioned near an end in the length direction;

a blister that is arranged in a diagonal width direction of the blister card and sealed to the blister card;

the blister including:

a blister shell configured to secure a product therein; and a flange portion that extends in a plane orthogonal from the blister shell, the plane including a perimeter of the blister shell, wherein an edge of the flange portion near a first end portion of the blister includes an indentation to avoid the aperture on the blister card, an edge of the flange portion near a second end portion of the blister opposite to the first end portion, includes an indentation at least substantially identical to the indentation provided near the first end portion, and the blister has point symmetry about a center point of the blister.

2. The product packaging container of claim 1, wherein the center point of the blister and the center point of the blister card coincide.

3. The product packaging container of claim 1, wherein the blister is arranged at a 10° angle off center in the length direction.

4. The product packaging container of claim 1, wherein the indentation of the flange portion has an arc shape.

5. The product packaging container of claim 4, wherein the arc shape has a radius greater than a radius of the aperture.

6. The product packaging container of claim 1, wherein the flange portion decreases and angles toward the perimeter of the blister shell as the flange portion approaches an edge of the card near a corner of the card.

7. The product packaging container of claim 1, wherein the plane of the flange portion is parallel to a plane of the rectangular blister card.

8. A product packaging container comprising:

a rectangular blister card having a width and length, the blister card including an aperture that is positioned near an end in the length direction;

a blister that is arranged in a diagonal width direction of the blister card and sealed to the blister card;

the blister including:

a blister shell configured to secure a product therein; and a flange portion that extends in a plane orthogonal from the blister shell, the plane including a perimeter of the blister shell, wherein the flange portion near a first end portion of the blister surrounds the aperture such that there is a portion of the blister card that is not sealed to the blister and is between the aperture and an edge of the flanged portion, an edge of the flange portion near a second end portion of the blister opposite to the first end portion is substantially similar to the edge of the flange portion near the first end portion of the blister, and the blister has point symmetry about a center point of the blister.

9. A container for housing one or more articles, comprising:

a base member having a geometric shape including at least one axis of symmetry;

a shell member sized and dimensioned to at least partially encapsulate at least one article of manufacture, the shell member having a major dimension along a major axis, the major axis of the shell member arranged at an angle to at least one axis of symmetry of the base member when sealed to the base member;

the shell member having a flange portion that extends outwardly in a plane including a perimeter of the shell member;

the flange portion having a least one flange structure near a first end of the shell member that is rotationally symmetric, about an axis perpendicular to the major axis of the shell member, to at least one flange structure near a second end of the shell member, wherein the flange portion includes an indentation to avoid an aperture on the base member.

10. The container for housing one or more articles of claim 9, wherein the major axis of the shell member is arranged at an angle between 8° and 15° off center of the base member in a length direction of the base member.

* * * * *